US008110071B2

(12) United States Patent
Ullmann et al.

(10) Patent No.: US 8,110,071 B2
(45) Date of Patent: Feb. 7, 2012

(54) PAPERS PROVIDING GREAT FAT AND OIL PENETRATION RESISTANCE, AND METHOD FOR THE PRODUCTION THEREOF

(75) Inventors: Bernd Ullmann, Bockau (DE); Thomas Claussen, Lunen (DE); Robert Fuss, Liederbach (DE); Richard Weilbacher, Florsheim (DE)

(73) Assignees: Kuraray Europe GmbH, Frankfurt (DE); Fahrbrucke Papier GmbH, Langenweisbach (DE)

( * ) Notice: Subject to any disclaimer, the term of this patent is extended or adjusted under 35 U.S.C. 154(b) by 907 days.

(21) Appl. No.: 10/594,753

(22) PCT Filed: Mar. 31, 2005

(86) PCT No.: PCT/DE2005/000577

§ 371 (c)(1),
(2), (4) Date: May 22, 2008

(87) PCT Pub. No.: WO2005/095710

PCT Pub. Date: Oct. 13, 2005

(65) Prior Publication Data

US 2008/0233385 A1 Sep. 25, 2008

(30) Foreign Application Priority Data

Mar. 31, 2004 (DE) ..... 10 2004 016 590
Apr. 20, 2004 (DE) ..... 10 2004 019 734

(51) Int. Cl.
*D21F 11/00* (2006.01)

(52) U.S. Cl. ..... 162/158; 162/164.1; 428/320.2

(58) Field of Classification Search ..... None
See application file for complete search history.

(56) References Cited

U.S. PATENT DOCUMENTS

| | | | |
|---|---|---|---|
| 4,548,676 | A | 10/1985 | Johnstone et al. |
| 4,837,087 | A | 6/1989 | Floyd et al. |
| 5,866,618 | A | 2/1999 | Nguyen |
| 6,294,265 | B1 | 9/2001 | Ioelovich et al. |
| 2003/0198885 | A1 | 10/2003 | Shigehisa et al. |

FOREIGN PATENT DOCUMENTS

| | | |
|---|---|---|
| CA | 2100117 A1 | 1/1994 |
| DE | 43 23 560 | 1/1994 |
| EP | 0 545 043 | 10/1992 |
| EP | 0 697 622 | 2/1996 |
| WO | WO 01/21881 | 3/2001 |
| WO | WO 2004/111336 | 12/2004 |

OTHER PUBLICATIONS

EP 0545043, Jun. 1993, machine translation.*
EP 0697622, Feb. 1996, machine translation.*
EP 0 545 043 B1, translation,from German, Aug. 1995.*
English Translation of International Preliminary Report issued Feb. 8, 2007 in PCT/DE2005/000577.

* cited by examiner

*Primary Examiner* — Mark Halpern
(74) *Attorney, Agent, or Firm* — Millen, White, Zelano & Branigan, P.C.

(57) ABSTRACT

Different papers known in prior art develop only moderate resistance to fats or contain fluorocarbon compounds or chromium complexes in the mass or in an impregnating liquor in order to develop great fat and oil penetration resistance. Said fluoride or chromium compounds represent substances that are known to be or at least seriously suspected of being unhealthy. Hence, the aim of the invention is to create a paper that is free from unhealthy components while being provided with great fat and oil penetration resistance, being easy to print, and being recyclable. Said aim is achieved by obtaining great fat and oil penetration resistance by using a paper that is made of thoroughly ground fiber materials and is glued with alkenyl succinic anhydride in the mass during impregnation inside or outside the papermaking machine with an impregnating liquor containing polyvinyl alcohols, ethylene-vinyl alcohol copolymers, polyvinyl butyrals, carboxymethylcellulose, gelatin, alginates, galactoglucomannans, and/or starch derivatives, polyvinyl alcohol and gelatine being preferred.

23 Claims, No Drawings

PAPERS PROVIDING GREAT FAT AND OIL PENETRATION RESISTANCE, AND METHOD FOR THE PRODUCTION THEREOF

This application is a 371 of PCT/DE2005/000577 filed on 31 Mar. 2005.

The invention relates to a process for the production of impregnated papers within or outside of the paper machine according to which process the papers are provided with a high penetration resistance to fats and oils.

Various processes are known which are suitable for providing papers with a penetration resistance to fats and oils. These are processes which are used both within the paper machine and also outside of the paper machine. In the case of the known processes, the penetration resistance to fats and oils can reach different qualitative gradations which are verifiable according to generally recognised and standardised test methods.

A process is known according to which a paper web consisting off cellulose fibres is passed through a hot, aqueous zinc chloride solution or through a sulphuric acid bath and thereby a high imperviousness to fats is achieved by partial hydrolysis of the cellulose. Paper equipped by means of this process with a high penetration resistance to fats and oils is no longer recyclable.

In addition, processes are known in which chromium salts of fatty acids are used to produce a high penetration resistance to fats and oils. Papers treated according to this process contain chromium as heavy metal and are consequently considered as harmful to health in so far as foodstuffs are packaged with them.

Processes are also known according to which papers are impregnated within or outside of the paper machine with impregnation media which use organic fluorine compounds to produce the intended penetration resistance to fats and oils. These organic fluorine compounds are diluted merely with water or incorporated into the paper in combination with solutions of binders and/or dispersions of synthetic polymers. The penetration resistance to fats and oils achievable with organic fluorine compounds is high, measured according to generally recognised and standardised test methods; however, the organic fluorine compounds migrate into the packaged product.

If the packaged product is a food or an animal feed, these organic fluorine compounds pass into the food chain. However, since they are degraded neither by the human nor by the animal metabolism, they remain in the body. In this respect, they are suspected of damaging the human and animal biological genotype. Moreover, as a result of their use for packaging dry or moist fatty foods, these papers are regularly provided with a wet strength finish and epichlorohydrin resins are used for this purpose which contain the harmful substances monochloropropane diol (MCPD) and dichloropropanol (DCP).

In addition, processes are known according to which the paper web is impregnated within or outside of the paper machine with solutions of native and/or synthetic polymers, paraffins and waxes. These are solutions of starches and starch derivatives and/or galactomannans and/or polyvinyl alcohols and/or carboxymethylcelluloses and/or solutions of other synthetic polymers, apart from polyvinyl alcohols, e.g. anionic polyacrylamides.

Paper produced according to such a process has only a low imperviousness to fats, tested according to generally recognised and standardised test methods.

Processes are also known according to which the paper is impregnated within or outside of the paper machine with aqueous dispersions of paraffins and/or waxes and the imperviousness to fat is thus produced. The papers thus treated are no longer recyclable if such quantities are used that a fat and oil barrier is achieved.

In addition, processes are known according to which the paper is sealed at the surface within or outside of the paper machine. In this case, the high penetration resistance to fats and oils is achieved by means of the necessarily required closed film formation. Polymer dispersions and/or wax dispersions and/or paraffin dispersions are used as the means for this. Papers produced according to this process are no longer recyclable. If a combination of polyolefin dispersions and wax dispersions and/or paraffin dispersions is used, the printability of the paper also suffers with an increasing content of wax and/or paraffin dispersions.

In addition, processes are known according to which high penetration resistances to oils and fats are provided by means of melts of polymers and/or waxes and/or hot melts and/or paraffins to papers by way of extrusion coating. Such extrusion coating is possible only outside of the paper machine. Papers produced according to this process are no longer recyclable.

In addition, processes are known according to which hydrogenated fatty acids are used to produce the penetration resistance to fats and oils. Patent specification DE 41 33 716 C1 describes such a process. Accordingly, coating from the melt of the hydrogenated fatty acid takes place on a separate coating facility outside of the paper machine. Papers produced in this way are no longer printable.

Finally, processes are known for providing papers with a barrier effective short term to fats and oils by particularly strong beating of their fibre stuff during mechanical parchmentisation. EP 1 170 418 A1 describes a coating for fat-resistant paper with a special hydrophobically modified starch.

The invention has the object of providing a paper with a high penetration resistance to fats and oils by way of a novel design of the chemical technology while it remains recyclable, printable and contains no harmful substances such as heavy metals, fluorocarbon compounds, monochloropropane diol, dichloropropanol or formaldehyde as a result of its formulation.

The invention is based on the task of providing a paper which has a high penetration resistance to fats and oils, which is easily recyclable, easily printable and free from the above-mentioned harmful substances as well as indicating a process for the production of such a paper.

According to the invention, the task is achieved by way of a paper according to claim 1 and a process according to claim 12.

The degree of beating is determined as Schopper-Riegler value (° SR) according to ISO 5267-1. According to the invention, a value of 65-900° SR, in particular of 78-82° SR is preferred. It is also possible to use low value papers (cardboard) with a degree of beating of 15-65° SR, in particular 30-65° SR.

For internal sizing, the sizing systems such as alkenyl succinic anhydride (ASA), alkyl ketene dimers (AKD) or resin sizes (tree resin) commonly used in the paper industry can be used.

For example, the alkenyl succinic anhydride (ASA) used for sizing can be a reaction product of maleic anhydride and α-olefins with 16 to 20 carbon atoms. According to the invention, it is preferably used in a quantity of 0.05 to 0.3 mass %, preferably 0.1 mass %, based on the dry paper. For this purpose, it is emulsified by means of a protective colloid, such as e.g. cationic starch. An illustration of this so-called ASA sizing with further literature references is provided e.g. by T. Gliese, "Alkenylbernsteinsaureanhydrid (ASA) als Leimungsmittel" (Alkenyl succinic anhydride (ASA) as size), Das Papier 2003, T141-T145.

The treatment with the aqueous impregnating liquor can take place both inside the paper machine as well as outside of it. Apart from the binder system, the liquor may contain further auxiliary agents such as crosslinking agents, complexing agents etc.

The binder system consists of water-soluble binders and, optionally, water-insoluble polymers. Water-insoluble polymers are preferably polyacrylonitriles, polyacrylates, polyvinyl acetates and polystyrene-polyacrylate copolymers. Their proportion should not be such that the paper is no longer recyclable and, according to the invention, amounts to a maximum of 20 mass %.

According to the invention, water-soluble binders are preferably polyvinyl alcohols, polyvinyl alcohols containing carboxyl groups (vinyl alcohol carboxylic acid copolymers), ethylene-vinyl alcohol copolymers, acetalised ethylene-vinyl alcohol copolymers, acetalised polyvinyl alcohols, polyvinyl butyrals, cationically modified polyvinyl alcohols containing silanol groups, acetalised cationically modified polyvinyl alcohols containing acetalised silanol groups, acetalised polyvinyl alcohols containing carboxyl groups, gelatin, galactomannan, alginates, carboxymethylcellulose and starches as well as mixtures of several binders selected from these classes of substances.

For the acetylation of the optional polyvinyl alcohols containing silanol groups and carboxyl groups or cationically modified polyvinyl alcohols and the ethyl-vinyl alcohol copolymers, C1-C10 alkanals or substituted or unsubstituted aromatic aldehydes can be used individually or as a mixture. Formaldehyde, acetaldehyde, propionaldehyde, benzaldehyde and/or benzaldehyde sulphonic acid are particularly suitable as alkali salt (sodium salt).

Particularly preferably, the binder system comprises polyvinyl alcohol and gelatin. In this case, such gelatin is preferred whose aqueous solution with 0.1 mass % at 24° C. has a surface tension of less than 42 mN/m. A combination of these components with polyvinyl alcohol containing carboxyl groups and/or at least one compound of the group of ethylene-vinyl alcohol copolymer, acetalised ethylene-vinyl alcohol copolymer, acetalised polyvinyl alcohol, acetalised cationically modified polyvinyl alcohols containing acetalised silanol groups and/or polyvinyl butyral is advantageous.

It is equally preferred to achieve the polyvinyl alcohol content of the binder system by a mixture of at least two different polyvinyl alcohols at least one of which has a viscosity of less than, the other and/or the others one of more than 35 mPa·s. In this application, viscosity of polyvinyl alcohol should be understood to mean the viscosity measured according to DIN 53015 on an aqueous solution with 4 mass % at 20° C.

Preferably, the impregnating liquor for the production of the sheet of paper according to the invention contains a crosslinking agent, particularly preferably glyoxal, in a concentration of 2 to 15 mass percent, based on the total quantity of binder and crosslinking agent.

Advantageously, the concentration of the impregnating liquor is between 2 and 15, preferably between 5 and 7.5 mass percent of dry substance.

The coating weight of the impregnating liquor, calculated as dry substance, is preferably between 0.3 and 1.5 g/m$^2$ per side.

The process for the production of the sheet of paper according to the invention comprises the production of a raw paper from pulp, mechanical wood pulp or recycled waste paper with the above-mentioned degrees of beating, internal sizing of the paper in particular with alkenyl succinic anhydride (ASA) and the impregnation of the sized raw paper with an impregnating liquor which contains a binder system of 80 to 100 parts by mass of water-soluble binder and 20 to 0 parts by mass of water-insoluble polymers in dispersion.

The impregnation can take place both in the paper machine as well as outside of the latter. Usual types of equipment, e.g. size presses, film presses etc. can be used for this purpose. Preferably, the raw paper is dried before impregnation to a dry matter content of 95 to 99%. Impregnation is also followed by a drying process to the required final moisture content.

Nine preferred embodiments of the impregnating liquor according to the invention are given in table 1. The water-soluble binders suitable for this purpose are characterised as follows:

Polyvinyl alcohol (PVA) by the viscosity determined according to DIN 53015 (in mPa·s) on an aqueous solution with 4 mass % at 20° C. and the degree of hydrolysis, expressed in % of hydrolysed vinyl acetate groups. Suitable products are sold under the trade names Mowiol and Poval, for example, by Kuraray Specialties Europe.

Polyvinyl alcohol (PVA-C) containing carboxyl groups also by the viscosity and degree of hydrolysis as above. Suitable products are the types KL-318 and KL-506 from Kuraray Specialties Europe.

Cationically modified polyvinyl alcohol (PVA-K) also by the viscosity and degree of hydrolysis as above. Suitable products are the types Cm-318, C-118 and C-506 from Kuraray Specialties Europe.

Polyvinyl alcohol containing silanol groups (PVA-R) also by the viscosity and degree of hydrolysis as above. A suitable product is e.g. type R-1130 from Kuraray Specialties Europe.

Ethylene-vinyl alcohol copolymer (PEVA) also by the viscosity and degree of hydrolysis. Suitable products are sold under the trade name Exceval by Kuraray Specialties Europe, e.g. type HR-3010. PEVA can be produced by the copolymerisation of vinyl acetate and ethylene and the subsequent hydrolysis of the vinyl acetate units to vinyl alcohol units.

Acetalised polyvinyl alcohols suitable for use as polyvinyl butyral (PVB) are also characterised by the viscosity, the degree of hydrolysis and the degree of acetalisation. To maintain the water-solubility, the degree of acetalisation is maximum 30 mole %.

The acetalised polyvinyl alcohols usable according to the invention, such as polyvinyl butyral, are obtained by the acetylation of a polyvinyl acetate produced by hydrolysis. Homopolymers of vinyl acetate as well as copolymers of olefins such as ethylene, propylene or other α-olefins with vinyl acetate can be used as polyvinyl acetate. The polymers obtained after the hydrolysis contain 0 to 15 mole % olefin units, 50 to 99.9 mole %, preferably 75 to 99.9 mole %, particularly preferably 85 to 99.9 mole % vinyl alcohol units and 0.1 to 50 mole %, preferably 0.1 to 25 mole %, particularly preferably 0.1 to 15 mole % vinyl acetate units. The acetylation with the above-mentioned aldehydes takes place up to a degree of acetalisation of 1 to 30 mole %, preferably 1 to 20 mole %. The cationically modified polyvinyl alcohols containing silanol groups and carboxyl groups described above can be acetalised in an analogous manner.

Gelatin by its surface tension in mN/m, measured on an aqueous solution with 0.1 mass % at 24° C. Suitable products are the types GELITA Imagel MA (39 mN/m) and GELITA Imagel BP (56 mN/m, trade marks of Stoess AG).

Carboxymethylcellulose (CMC) is suitable in the commercial form.

Alginate can be used as sodium alginate obtainable from Kimica Corp., Japan, for example.

The recipes given in Table 1 comprise proportions by mass of the dry substance of the impregnating liquor which additionally contains essentially only water. The dry substance content of the liquor may be between 2 and 15 mass %, preferably between 5 and 7.5 mass %. The preferred values for each component are indicated in addition to the suitable quantity ranges.

The impregnating liquors according to the invention can be produced by dissolving the components in water at 90 to 95 ° C., if necessary after swelling of individual ones of the dry components in cold water.

TABLE 1

Preferred embodiments according to the invention

| | Embodiment | | | | | |
|---|---|---|---|---|---|---|
| | 1 | 2 | 3 | 4 | 5 | 6 |
| PVA 6 mPa · s, 98% | | 14-40 | | | | |
| preferably | | 30 | | | | |
| EVA 10 mPa · s, 98% | | | | 0-20 | 0-35 | 0-30 |
| preferably | | | | 11 | 15 | 8 |
| PVA 15 mPa · s, 79% | 5-10 | | 0-15 | | 0-15 | 0-20 |
| preferably | 7 | | 7 | | 7 | 7 |
| PVA 28 mPa · s, 99% | 15-40 | | 0-40 | 0-25 | 0-25 | 0-45 |
| preferably | 25 | | 25 | 15 | 20 | 28 |
| PVA 40 mPa · s, 88% | 10-20 | | 0-20 | 0-20 | 0-20 | 0-20 |
| preferably | 12 | | 12 | 12 | 12 | 12 |
| PVA 56 mPa · s, 88% | 10-25 | | 0-25 | | 0-25 | 0-15 |
| preferably | 15 | | 15 | | 15 | 10 |
| PVA 72 mPa · s, 98% | | 15-45 | | 0-15 | | |
| preferably | | 30 | | 8 | | |
| PVA-C, 18 mPa · s, | 0-18 | | 0-18 | | | |
| 84% preferably | 15 | | 15 | | | |
| PEVA, 16-20 mPa · s, | 1-5 | L0-30 | | | | |
| 98% preferably | 3 | 15 | | | | |
| PEVA, 12-16 mPa · s, | | | | 0-18 | 0-30 | 0-22 |
| 99% preferably | | | | 9 | 10 | 8 |
| Gelatin 35-42 mN/m | 10-25 | 5-40 | 0-40 | 0-35 | 0-25 | 0-50 |
| preferably | 17 | 30 | 17 | 25 | 16 | 23 |
| Gelatin 55 mN/n | | | | 0-25 | | |
| preferably | | | | 10 | | |
| CMC | | 0.5-3 | | | | |
| preferably | | 1 | | | | |
| Alginate | | | 0-8 | | | |
| preferably | | | 3 | | | |
| Glyoxal preferably | 0-12 | | 0-15 | 0-12 | 0-12 | 0-12 |
| | 6 | | 6 | 10 | 5 | 4 |

| | Embodiment | | |
|---|---|---|---|
| | 7 | 8 | 9 |
| PVA 6 mPa · s, 98% | 14-30 | | |
| preferably | 19 | | |
| PVA 10 mPa · s, 98% | | | |
| preferably | | | |
| PVA 15 mPa · s, 79% | 20-40 | | |
| preferably | 29 | | |
| PVA 28 mPa · s, 99% | 8-20 | | |
| preferably | 13 | | |
| PVA 40 mPa · s, 88% | 14-30 | | |
| preferably | 19 | | |
| PVA 56 mPa · s, 88% | | | |
| preferably | | | |
| PVA 72 mPa · s, 98% | | | |
| preferably | | | |
| PVA-C, 18 mPa · s, 84% | | | |
| preferably | | | |
| PEVA, 16-20 mPa · s, 98% | | 15-40 | 0-50 |
| preferably | | 26 | 12 |

TABLE 1-continued

Preferred embodiments according to the invention

| | | | |
|---|---|---|---|
| PEVA, 12-16 mPa · s, 99% | | 40-80 | |
| preferably | | 66 | |
| Gelatin 35-42 mN/m | | | |
| preferably | | | |
| Gelatin 55 mN/m | | | |
| preferably | | | |
| CMC | | | |
| preferably | | | |
| Alginate preferably | | | |
| Glyoxal preferably | 0-15 | 0-15 | 0-15 |
| | 5 | 8 | 8 |
| Polyvinylbutyral | | | 5-90 |
| preferably | | | 70 |

The impregnating liquors thus produced are applied onto a raw paper of pulp with a degree of beating of 65 to 90° SR, preferably 78-82° SR which has been internal sized with alkylene succinic acid, within or outside of the paper machine on one or both sides. A preferred range of the coating weight is between 0.3 and 1.5 g/m$^2$ per side, calculated as dry substance in the liquor.

The impregnation of the paper web takes place using one of the generally known coating processes within or outside of the paper machine and subsequent drying of the web on drying cylinders or also in a contact-free manner, e.g. in floating dryers.

The invention can be carried out within a wide range of basis weights of the raw paper. Papers with 28-350 g/m$^2$ are preferred.

Surprisingly, it has been found that a paper web produced in the manner according to the invention has a high penetration resistance to fats and oils measured according to the generally recognised and standardised test methods as in examples 1 to 3 even though the individual components of polyvinyl alcohol or gelatin or CMC or ethylene-vinyl alcohol copolymer or alginates or galactomannans or starch derivates develop only slight penetration resistances to oils and fats.

Surprisingly, it has also been found that the papers produced in the manner according to the invention have a wet strength of 5 to 20%, determined according to DIN ISO 3781 without wet strength improving agents needing to be used.

PRACTICAL EXAMPLES

The following examples are to serve as a further explanation of the invention, examples 1 and 2 describing the state of art and example 3 the process according to the invention. Examples 4 to 14 relate to polymers suitable for use according to the invention, examples 15 to 30 to the papers impregnated with these polymers.

The relevant test results determined on the finished paper are given in Table 2. The impregnation media described in the examples were applied with a size press onto unsized raw paper (example 1 and 2—state of the art), whereas the impregnating liquor in example 3 is applied with a size press onto raw paper (according to the invention) sized with alkenyl succinic anhydride.

All the raw papers mentioned in examples 1, 2 and 3 are produced from pulps which had been provided with a degree of beating of 78° SR to 82° SR. The impregnation takes place at a speed of the paper web of approximately 600 m/min. The applying takes place on both sides of the paper web. Drying after impregnation takes place initially without contact in an infrared dryer and subsequently with drying cylinders.

Example 1

According to the State of Art

A paper web is produced from fibre stuff. As described above, this fibre stuff suspension, 2%, based on the paper, of a 12% epichlorohydrin resin solution are added in order to provide the paper with the intended wet strength. The pre-dried paper web having a dry matter content of 95 to 99% is impregnated in a size press with an impregnating liquor consisting of 2 parts by mass of complexing agent solution, 10 parts by mass of polyvinyl alcohol with a viscosity, determined as described above, of 28 mPa·s and a degree of hydrolysis of 99%, 6.5 parts by mass of CMC with an average viscosity, 6.5 parts by mass of a galactomannan, 65 parts by mass of a potato starch ester with film-forming properties (Perfectamyl 150A—Avebe), 10 parts by mass of a glyoxal solution with a 40% concentration and 25 parts by mass of a 33% solution of fluorocarbons (Cartafluor UHC—Clariant AG or Baysize FCP—Bayer AG) as well as water. The impregnating liquor has a pH of 7.0 to 7.3, a viscosity determined as outflow time from the Ford beaker with a nozzle of 4 mm at 20° C. of 27 to 30 s and a concentration of dry substance of 6.4 to 6.5%. The application weight on the raw paper is 0.9 g/m$^2$ per side, i.e. 1.8 g/m$^2$ in total. After impregnation, the paper web is again dried to a final dry matter content of 93%.

The penetration resistances to oil and fats are determined on this paper (compare also Table 1):

Fat density according to DIN 53116

| | |
|---|---|
| Stage V: | No permeability |
| Stage IV: | No permeability |
| Stage III: | No permeability |
| Stage II: | 2 cases of penetration |
| Stage 1: | 30 cases of penetration including 10 of more than 1 mm$^2$ |

In the case of the test method according to DIN 53116, palm kernel oil dyed red is applied onto the test specimen onto a surface of 50 cm$^2$ by means of a template. Stage V indicates the cases of penetration after 10 min which are counted on white sheet of paper placed underneath. Stage IV is also determined after a test period of 10 min, however the palm kernel oil was subjected to a pressure of 20 N/cm$^2$. The same pressure is applied in stages III, II and I; however, the test period is 60 min (stage III), 24 hours (stage II) and 36 hours (stage I) in this case.

Fat density according to Tappi T454: t>1800 s.

In the case of this Tappi T454 test method, a defined small heap of a defined dry sand is placed onto the test specimen and 1.1 ml of spirit of turpentine dyed red is added dropwise to this small heap. The time in seconds is then measured and indicated as the result after which the first red penetration appears on a white sheet of paper present underneath the test specimen.

According to Tappi T454, a time of 1800 s corresponds to a high penetration resistance to fats and oils.

As a result of the use of epichlorohydrin resins for wet strengthening, the paper contains the critical substances of monochloropropane diol and dichloropropanol in a quantity permissible according to the law. In addition, it contains organically bound fluorine which is suspected of having a damaging effect on the genotype.

Example 2

According to the State of the Art

A paper web is produced from fibre stuff as described in example 1. Again as in example 1, 0.5 to 2%, based on the paper, of a 12% epichlorohydrin resin solution is added to this fibre stuff suspension in order to provide the paper with a desired wet strength.

The pre-dried paper web having a dry matter content of 95 to 99% is then impregnated in a size press with an impregnating liquor consisting of 12 parts by mass of polyvinyl alcohol with a viscosity, determined as above, of 28 mPa·s and a degree of hydrolysis of 99%, 7 parts by mass of CMC with an average viscosity, 7 parts by mass of a galactomannan, 70 parts by mass of a potato starch ester with film-forming properties and 10 parts by mass of a 40% glyoxal solution as well as water.

The impregnating liquor contains no fluorocarbon compounds. It has a pH of 6.2-6.8, a viscosity determined as outflow time from the Ford beaker with a nozzle of 4 mm of 27 s and a concentration of dry substance of 6.1 to 6.3%. The coating weight on the raw paper is 0.6 g/m$^2$ per page, i.e. 1.2 g/m$^2$ in total. The paper web is dried again after impregnation to a final dry matter content of 93%.

The following penetration resistances to fats and oils are determined on finished paper impregnated according to example 2 (compare also Table 1):

Fat density according to DIN 53116

| | |
|---|---|
| Stage V: | No permeability |
| Stage IV: | 65 cases of penetration including 16 of more than 1 mm$^2$ |
| Stage III, II, 1: | Penetration over large surface area |

Fat density according to Tappi T454: t=20 sec.

As a result of the use of epichlorohydrin resins for wet strengthening, the paper contains monochloropropane diol and dichloropropanol in quantities permitted according to the law. However, it has only a low penetration resistance to fats and oils.

Example 3

According to the Invention

A paper web is produced from fibre stuff as described in example 1. No epichlorohydrin resin is added to the fibre stuff suspension; however, 0.1% alkenyl succinic anhydride (Baysize 18—Bayer) and 0.9% cationic potato starch (HI-CAT 145—Roquette Freres), based on the paper, are added to the fibre stuff suspension.

The pre-dried paper web having a dry matter content of 96 to 99% is then impregnated in the size press with an impregnating liquor consisting of 7 parts by mass of a polyvinyl alcohol with a viscosity, determined as above, of 15 mPa·s and a degree of hydrolysis of 79%, 25 parts by mass of a polyvinyl alcohol with a viscosity of 28 mPa·s and a degree of hydrolysis of 99%, 12 parts by mass of a polyvinyl alcohol with a viscosity of 40 mPa·s and a degree of hydrolysis of 88%, 15 parts by mass of a polyvinyl alcohol with a viscosity of 56 mPa·s and a degree of hydrolysis of 88%, 15 parts by mass of a carboxyl group-containing polyvinyl alcohol with a viscosity of 18 mPa·s and a degree of hydrolysis of 84%, 17 parts by mass of a gelatin with a surface tension of 38 mN/m, measured as described above, 3 parts by mass of an ethylene-vinyl alcohol copolymer with a viscosity of 18 mPa·s and a degree of hydrolysis of 98% (according to example 10 or 11) and 15 parts by mass of a 40% solution of glyoxal for crosslinking of the components, as well as water. The impregnating liquor has a pH of 6.4 to 6.9, a viscosity determined according to the outflow time from the Ford beaker with a nozzle of 4 mm of 30 to 32 s and a concentration of 7.2 to 7.4%. The dry application weight was 1.2 g/m$^2$ per side.

After impregnation, the paper web is again dried to a final dry matter content of 93%. The following penetration resistances to fats and oils are determined on the paper produced according to the process of the invention (compare also Table 2):

Fat density according to DIN 53116

| | |
|---|---|
| Stage V: | No permeability |
| Stage IV: | No permeability |
| Stage III | No permeability |
| Stage II: | 3 cases of penetration |
| Stage I: | 28 cases of penetration |

Fat density according to Tappi T454: t>1800 s.
Wet strength: 5%

TABLE 2

Recipes and test results of the examples

| | Expl. 1 SdT | Expl. 2 SdT | Expl. 3 invention |
|---|---|---|---|
| Epichlorohydrin resin 12% | 2 | 2 | 0 |
| Sizing | non | non | ASA |
| Basis weight g/m2 | 40 | 40 | 40 |
| Recipe of the impregnating liquor | | | |
| PVA 15 mPa · s, 79% | | | 7 |
| PVA 28 mPa · s, 99% | 10 | 12 | 25 |
| PVA 40 mPa · s, 88% | | | 12 |
| PVA 56 mPa · s, 88% | | | 15 |
| PVA-C, 18 mPa · s, 84% | | | 15 |
| PEVA, 16-20 mPa · s, 98% | | | 3 |
| Gelatin 38 mN/m | | | 17 |
| CMC | 6.5 | 7 | |
| Potato starch ester | 65 | 70 | |
| Galactomannan | 6.5 | 7 | |
| Glyoxal | 4 | 4 | 6 |
| Fluorocarbon | 8 | | |
| Application weight (g/m2 per side) | 0.9 | 0.6 | 1.2 |
| Test results | | | |
| Fat density according to DIN 53116 | | | |
| Stage V | 0 | 0 | 0 |
| Stage IV | 0 | 65/16 | 0 |
| Stage III | 0 | LP | 0 |
| Stage II | 2 | LP | 3 |
| Stage I | 30/10 | LP | 28 |
| Fat density according to TAPPI T454 | >1800 s | 20 s | >1800 s |
| Wet strength DIN ISO 3781 | 22% | 23% | 5% |

LP means large surface area penetration; in the case of numerous cases of penetration, the number of penetrations more than 1 mm$^2$ is indicated behind the oblique.

The recipes and test results of practical examples 1 to 3 are summarised in Table 2. The recipes of the liquor are given in mass % of the dry substance. The results show that the same high penetration resistances can be achieved with Example 3 according to the invention as in the case of Example 1 corresponding to the state of the art, without using fluorocarbon compounds.

The paper produced according to Example 3 of the invention has a high penetration resistance to fats and oils, is free from organically bound halogen, including epichlorohydrin resin and fluorocarbon compounds, is free from heavy metals, is recyclable, is printable with printing inks based both on water and on solvents and is formed within the paper machine as part of the production process.

Examples for the Production of Acetalised Polyvinyl Alcohols and their Use for the Production of Papers According to the Invention

Example 4

720 g of polyvinyl alcohol Mowiol® 28-99 are dissolved in 6480 ml of water. After introducing 29.01 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 23 mPa·s in the case of a solution of 4% by weight in water and 302 mPa·s in the case of an 8% by weight solution in water. The product has no turbidity point and no precipitation point. The glass transition point (Tg) determined by DSC measurement is 78° C.

Example 5

1080 g of polyvinyl alcohol Mowiol® 15-99 are dissolved in 6120 ml of water. After introducing 60.8 g of n-butyraldehyde, the pH is adjusted to approximately 2 with 20% hydrochloric acid. The solution is additionally stirred for 2 hours at the adjusted pH. Subsequently, the solution is adjusted to a pH of 6-6.5 with 10% caustic soda solution and stirred for a further 1 hour. The viscosity according to Höppler according to DIN 53015 is 15 mPa·s in the case of a solution of 4% by weight. in water and 138 mPa·s in the case of an 8% by weight solution in water. The solutions are already turbid at room temperature. If they are heated, they precipitate out at approximately 76° C. The glass transition point (Tg) determined by DSC measurement is 83° C.

Example 6

1440 g of polyvinyl alcohol Mowiol® 4-98 are dissolved in 5760 ml of water. After introducing 172.02 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 5 mPa·s in the case of a solution of 4% by weight in water and 21 mPa·s in the case of an 8% by weight solution in water. The solutions are already turbid at room temperature. If they are heated, they precipitate out at approximately 30° C. The glass transition point (Tg) determined by DSC measurement is 79° C.

Example 7

1440 g of polyvinyl alcohol Mowiol® 5-88 are dissolved in 5760 ml of water. After introducing 92.52 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 5 mPa·s in the case of a solution of 4% by weight in water and 23 mPa·s in the case of an 8% by weight solution in water. The solutions are already turbid at room temperature. If they are heated, they precipitate out at approximately 30° C. The glass transition point (Tg) determined by DSC measurement is 72° C.

Example 8

1080 g of polyvinyl alcohol Mowiol® 15-99 are dissolved in 6120 ml of water. After introducing 60.8 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 14 mPa·s in the case of a solution of 4% by weight in water and 124 mPa·s in the case of an 8% by weight solution in water. The solutions are already turbid at room temperature. If they are heated, they precipitate out at approximately 70° C. The glass transition point (Tg) determined by DSC measurement is 81° C.

Example 9

1080 g of polyvinyl alcohol Mowiol® 26-88 are dissolved in 6120 ml of water. After introducing 69.4 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 23 mPa·s in the case of a solution of 4% by weight in water and 328 mPa·s in the case of an 8% by weight solution in water. The solutions are already turbid at room temperature. If they are heated, they precipitate out at approximately 33° C. The glass transition point (Tg) determined by DSC measurement is 78° C.

Example 10

1062.5 polyvinyl alcohol Exceval RS-2117 are dissolved in 7437.5 ml of water. After introducing 41.57 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 19 mPa·s in the case of a solution of 4% by weight in water and 261 mPa·s in the case of an 8% by weight solution in water. The solutions become turbid at approx. 41° C. If they are heated further, they precipitate out at approximately 48° C. The glass transition point (Tg) determined by DSC measurement is 77° C.

Example 11

900 g of polyvinyl alcohol Exceval HR-3010 are dissolved in 6300 ml of water. After introducing 43.34 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 12.6 mPa·s in the case of a solution of 4% by weight in water and 130.4 mPa·s in the case of an 8% by weight solution in water. The solutions are already turbid at room temperature. If they are heated, they precipitate out at approximately 30° C. The glass transition point (Tg) determined by DSC measurement is 55° C.

Example 12

720 g of polyvinyl alcohol K-polymer KL-318 are dissolved in ml of water. After introducing 28.71 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 22 mPa·s in the case of a solution of 4% by weight in water and 282 mPa·s in the case of an 8% by weight solution in water. The solutions become turbid 73° C. If they are heated further, they do not precipitate out. The glass transition point (Tg) determined by DSC measurement is 78° C.

Example 13

900 g of polyvinyl alcohol R-polymer R-1130 are dissolved in 6300 ml of water. After introducing 21.67 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 20 mPa·s in the case of a solution of 4% by weight in water and 261 mPa·s in the case of an 8% by weight solution in water. The solutions become turbid 24° C. If they are heated further, they precipitate out at approx. 53° C. The glass transition point (Tg) determined by DSC measurement is 80° C.

Example 14

1080 g of polyvinyl alcohol C-polymer C-506 are dissolved in 6120 ml of water. After introducing 37.71 g of n-butyraldehyde, the pH is adjusted to approximately 1 with 20% hydrochloric acid. The solution is additionally stirred for 2 hours at the adjusted pH. Subsequently, the solution is adjusted to a pH of 6-8 with 10% caustic soda solution and stirred for a further 1 hour. The viscosity according to Höppler according to DIN 53015 is 4 mPa·s in the case of a solution of 4% by weight in water and 13 mPa·s in the case of an 8% by weight solution in water. The solutions become turbid 38° C. If they are heated further, they precipitate out at approx. 44° C. The glass transition point (Tg) determined by DSC measurement is 63° C.

In Table 3, examples of recipes with the polymers according to examples 4 to 14 for coating of papers are given.

Table 4 shows the penetration resistances of these papers.

TABLE 3

| | Example | | | | | | | | | | | | | | | |
|---|---|---|---|---|---|---|---|---|---|---|---|---|---|---|---|---|
| | 15 | 16 | 17 | 18 | 19 | 20 | 21 | 22 | 23 | 24 | 25 | 26 | 27 | 28 | 29 | 30 |
| PVA 56 mPa · s, 98% preferably | 0-95 22 | | | | 0-95 22 | | | | 0-95 22 | | | | 0-95 22 | | | |
| Glyoxal preferably | 0-15 8 | 0-15 8 | 0-15 8 | 0-15 8 | 0-15 8 | 0-15 8 | 0-15 8 | 0-15 8 | 0-15 8 | 0-15 8 | 0-15 8 | 0-15 8 | 0-15 8 | 0-15 8 | 0-15 8 | 0-15 8 |
| Polyvinylbutyral accord. to expl. 4 to 9 preferably | 5-90 70 | 5-90 70 | 5-90 70 | 5-90 70 | | | | | | | | | | | | |
| Polyvinylbutyral accrd.to expl. 12 preferably | | | | | 5-90 70 | 5-90 70 | 5-90 70 | 5-90 70 | | | | | | | | |
| Polyvinylbutyral accord. to expl. 14 preferably | | | | | | | | | 5-90 70 | 5-90 70 | 5-90 70 | 5-90 70 | | | | |
| Polyvinylbutyral accord. to expl. 13 preferably | | | | | | | | | | | | | 5-90 70 | 5-90 70 | 5-90 70 | 590 70 |
| PVA-C preferably | | 0-95 22 | | | | 0-95 22 | | | | 0-95 22 | | | | 0-95 22 | | |
| PVA-K preferably | | | 0-95 22 | | | | 0-95 22 | | | | 0-95 22 | | | | 0-95 22 | |
| PVA-R preferably | | | | 0-95 22 | | | | 0-95 22 | | | | 0-95 22 | | | | 0-95 22 |

TABLE 4

| | Example | | | | | | | |
|---|---|---|---|---|---|---|---|---|
| | 15 | 16 | 17 | 18 | 19 | 20 | 21 | 22 |
| Application weight (g/m2 per side) | 1.2 | 1.2 | 1.2 | 1.2 | 1.2 | 1.2 | 1.2 | 1.2 |
| Fat density accord. to DIN 53116 | | | | | | | | |
| Stage V | 0 | 0 | 0 | 0 | 0 | 0 | 0 | 0 |
| Stage IV | 0 | 0 | 0 | 0 | 0 | 0 | 0 | 0 |
| Stage III | 0 | 0 | 0 | 0 | 0 | 0 | 0 | 0 |
| Stage II | 2 | 3 | 0 | 2 | 10/2 | 10 | 2 | 4 |
| Stage I | 20/5 | 10 | 14 | 20/10 | 26 | 16 | 12 | 15/10 |
| Fat density accord. to Tappi T 454 Es] | 1680 | >1800 | >1800 | >1800 | >1800 | >1800 | >1800 | >1800 |
| Wet strength accord. to DIN Iso 3781 [%] | 15 | 15 | 17 | 13 | 15 | 16 | 18 | 20 |

| | Example | | | | | | | |
|---|---|---|---|---|---|---|---|---|
| | 23 | 24 | 25 | 26 | 27 | 28 | 29 | 30 |
| Application weight (g/m2 per side) | 1.2 | 1.2 | 1.2 | 1.2 | 1.2 | 1.2 | 1.2 | 1.2 |
| Fat density accord. to DIN 53116 | | | | | | | | |
| Stage V | 0 | 0 | 0 | 0 | 0 | 0 | 0 | 0 |
| Stage IV | 0 | 0 | 0 | 0 | 0 | 0 | 0 | 0 |
| Stage III | 0 | 0 | 0 | 0 | 0 | 0 | 0 | 0 |
| Stage II | 2 | 3 | 9 | 2 | 6 | 4/2 | 0 | 0 |
| Stage I | 10 | 14 | 20/10 | 28/8 | 20/10 | 30/16 | 10 | 8 |
| Fat density accord. to Tappi T 454 Es] | >1800 | >1800 | >1800 | >1800 | >1800 | 1500 | >1800 | >1800 |

TABLE 4-continued

| | | | | | | | | |
|---|---|---|---|---|---|---|---|---|
| Wet strength accord. to DIN Iso 3781 [%] | 24 | 16 | 15 | 18 | 16 | 15 | 15 | 15 |

The invention claimed is:

1. An impregnated paper with a high penetration resistance to fats and oils, comprising:

a paper produced from strongly beaten pulps with a degree of beating of 15° SR to 90° SR, and internally sized with alkenyl succinic anhydride and/or alkyl ketene dimers (AKD) and/or resin sizes, wherein said paper is impregnated with an impregnating liquor which contains a binder system of 80 to 100 parts by mass of water-soluble binders and 20 to 0 parts by mass of water-insoluble polymers in dispersion, wherein said water-soluble binders are selected from ethylene-vinyl alcohol copolymers, acetalized ethylene-vinyl alcohol copolymers, acetalized polyvinyl alcohols, polyvinyl butyrals, cationically modified polyvinyl alcohols containing silanol groups, acetalized cationically modified polyvinyl alcohols containing acetalized silanol groups, polyvinyl alcohols containing carboxyl groups, and mixtures thereof.

2. A paper according to claim 1, wherein said paper contains 0.05 to 0.3 mass percent of alkenyl succinic anhydride for internal sizing.

3. A paper according to claim 1, wherein said impregnating liquor contains water-insoluble polymers in dispersion, and said polymers in dispersion are selected from the group comprising polyacrylonitriles, polyacrylates, polyvinyl acetates and polystyrene-polyacrylate copolymers.

4. A paper according to claim 1, wherein the water-soluble binders are selected from acetalized polyvinyl alcohols, polyvinyl butyrals, cationically modified polyvinyl alcohols containing silanol groups, acetalized cationically modified polyvinyl alcohols containing acetalized silanol groups, polyvinyl alcohols containing carboxyl groups, and mixtures thereof.

5. A paper according to claim 1, wherein the water-soluble binders additionally comprise at least one polyvinyl alcohol containing carboxyl groups and/or at least one compound selected from ethylene-vinyl alcohol copolymers, acetalized ethylene-vinyl alcohol copolymers, acetalized polyvinyl alcohols, cationically modified polyvinyl alcohols containing silanol groups, polyvinyl alcohols containing acetalized silanol groups, acetalized carboxyl groups, acetalized cationically modified polyvinyl alcohols, and polyvinyl butyral.

6. A paper according to claim 1, wherein the impregnating liquor contains a cros slinking agent.

7. A paper according to claim 6, wherein the crosslinking agent is glyoxal.

8. An impregnated paper according to claim 6, wherein the concentration of the crosslinking agent in the impregnating liquor is 2 to 15 mass percent, based on the total quantity of binder and crosslinking agent.

9. A paper according to claim 1, wherein the application weight of the impregnating liquor, calculated as dry substance, is 0.3 to 1.5 g/m$^2$ per side.

10. An impregnated paper according to claim 1, wherein the concentration of the impregnating liquor is between 2 and 15 mass percent of dry substance.

11. An impregnated paper according to claim 1, wherein the concentration of the impregnating liquor is between 5 and 7.5 mass percent of dry substance.

12. An impregnated paper according to claim 1, wherein said paper has a penetration resistance to fats and oils of greater than 1800 s as determined by the Tappi T454 test method.

13. An impregnated paper according to claim 1, wherein said paper is not treated with fluorocarbons.

14. An impregnated paper according to claim 1, wherein said paper has a wet strength of 5 to 20%, determined according to DIN ISO 3781, without wet strength improving agents being added.

15. A paper according to claim 1, wherein the water-soluble binders are selected from acetalized polyvinyl alcohols, acetalized cationically modified polyvinyl alcohols containing acetalized silanol groups, and mixtures thereof.

16. A paper according to claim 1, wherein the water-soluble binders are selected from polyvinyl butyrals and mixtures thereof.

17. A process for the production of an impregnated paper according to claim 1, said process comprising:

producing a raw paper of pulp, mechanical wood pulp or recycled waste paper with a degree of beating of 15 SR to 90 SR with internal sizing with alkenyl succinic anhydride and/or alkyl ketene dimers (ATD) and/or resin sizes, and impregnating this paper with an impregnating liquor containing a binder system of 80 to 100 parts by mass of water-soluble binders and 20 to 0 parts by mass of water-insoluble polymers in dispersion, wherein said water-soluble binders are selected from ethylene-vinyl alcohol copolymers, acetalized ethylene-vinyl alcohol copolymers, acetalized polyvinyl alcohols, polyvinyl butyrals, cationically modified polyvinyl alcohols containing silanol groups, acetalized cationically modified polyvinyl alcohols containing acetalized silanol groups, polyvinyl alcohols containing carboxyl groups, and mixtures thereof.

18. A process according to claim 17, wherein said impregnating liquor contains water-insoluble polymers in dispersion, and said polymers in dispersion are selected from polyacrylonitriles, polyacrylates, polyvinyl acetates, and polystyrene-polyacrylate copolymers.

19. A process according to claim 17, wherein the water-soluble binders are selected from ethylene-vinyl alcohol copolymers, polyvinyl butyrals, and mixtures thereof.

20. A process according to claim 17, wherein the impregnation is carried out in a size press, film press or any other one of the known coating devices.

21. A process according to claim 17, wherein the sized raw paper is dried before impregnation to a dry matter content of 95 to 99%.

22. An impregnated paper with a high penetration resistance to fats and oils, wherein said paper is produced from strongly beaten pulps with a degree of beating of 15° SR to 90° SR, internal sized with alkenyl succinic anhydride and/or alkyl ketene dimers (AKD) and/or resin sizes and treated with an impregnating liquor which contains a binder system of 80 to 100 parts by mass of water-soluble binders and 20 to 0 parts by mass of water-insoluble polymers in dispersion, wherein said water-soluble binders are selected from polyvinyl alcohols, ethylene-vinyl alcohol copolymers, acetalized ethylene-vinyl alcohol copolymers, acetalized polyvinyl alcohols, polyvinyl butyrals, cationically modified polyvinyl alcohols containing silanol groups, acetalized cationically modified polyvinyl alcohols containing acetalized silanol groups, polyvinyl alcohols containing carboxyl groups, gelatin, galactomannans, alginates, carboxymethylcellulose, starches, and mixtures thereof, the concentration of the impregnating liquor is between 2 and 15 mass percent of dry substance, and the coating weight of the impregnating liquor, calculated as dry substance, is between 0.3 and 1.5 $g/m^2$ per side.

23. A process for the production of a paper comprising:

producing a raw paper of pulp, mechanical wood pulp or recycled waste paper with a degree of beating of 15 SR to 90 SR with internal sizing with alkenyl succinic anhydride and/or alkyl ketene dimers (ATD) and/or resin sizes, and impregnating this paper with an impregnating liquor containing a binder system of 80 to 100 parts by mass of water-soluble binders and 20 to 0 parts by mass of water-insoluble polymers in dispersion, wherein said water-soluble binders are selected from polyvinyl alcohols, ethylene-vinyl alcohol copolymers, acetalized ethylene-vinyl alcohol copolymers, acetalized polyvinyl alcohols, polyvinyl butyrals, cationically modified polyvinyl alcohols containing silanol groups, acetalized cationically modified polyvinyl alcohols containing acetalized silanol groups, polyvinyl alcohols containing carboxyl groups, gelatin, galactomannans, alginates, carboxymethylcellulose, starches, and mixtures thereof, the concentration of the impregnating liquor is between 2 and 15 mass percent of dry substance, and the coating weight of the impregnating liquor, calculated as dry substance, is between 0.3 and 1.5 $g/m^2$ per side.

* * * * *